US006324887B1

(12) United States Patent
Sharp

(10) Patent No.: US 6,324,887 B1
(45) Date of Patent: Dec. 4, 2001

(54) THREAD ROLLING DIES AND PROCESS FOR FORMING SAME

(75) Inventor: Bill O. Sharp, Fairview Park, OH (US)

(73) Assignee: Lake Erie Screw Corp., Cleveland, OH (US)

( * ) Notice: Subject to any disclaimer, the term of this patent is extended or adjusted under 35 U.S.C. 154(b) by 0 days.

(21) Appl. No.: 09/628,841

(22) Filed: Jul. 31, 2000

Related U.S. Application Data

(60) Provisional application No. 60/201,317, filed on May 2, 2000.

(51) Int. Cl.[7] ..... B21H 3/06
(52) U.S. Cl. ..... 72/469; 72/88
(58) Field of Search ..... 72/88, 90, 469

(56) References Cited

U.S. PATENT DOCUMENTS

| | | | | |
|---|---|---|---|---|
| 440,332 | * | 11/1890 | Rogers | 72/88 |
| 502,256 | * | 7/1893 | Jones | 72/88 |
| 510,109 | * | 12/1893 | Bement | 72/88 |
| 3,260,100 | * | 7/1966 | Wieber | 72/88 |
| 3,852,992 | | 12/1974 | Yamamoto . | |
| 4,353,233 | | 10/1982 | Chapman . | |
| 4,546,639 | * | 10/1985 | Corrette | 72/469 |
| 4,735,537 | | 4/1988 | Rath | 72/88 |
| 4,782,681 | | 11/1988 | Kawashima | 72/88 |
| 4,782,688 | | 11/1988 | Kawashima | 72/469 |
| 4,862,718 | | 9/1989 | LaCroix . | |
| 5,182,937 | | 2/1993 | Dickson | 72/469 |
| 5,243,843 | | 9/1993 | Dickson . | |
| 5,515,708 | | 5/1996 | D'Agostino . | |

FOREIGN PATENT DOCUMENTS

| | | |
|---|---|---|
| 533456 | 9/1992 | (EP) . |
| 63-5835(A) | 1/1988 | (JP) . |

* cited by examiner

*Primary Examiner*—Daniel C. Crane
(74) *Attorney, Agent, or Firm*—Edgar A. Zarins; Lloyd D. Doigan

(57) ABSTRACT

Thread forming dies to form a continuous helical thread for a metal fastener. The dies are designed and constructed to eliminate laps and discontinuities in the thread form particularly in larger diameter fastener blanks. The dies are constructed by calculating a roll-off section which tapers down to expel the threaded fastener then determining the length of a dwell section having a full depth grooves to create a well-defined and stable thread. Finally, a roll-up ramp section is calculated along which the grooves of the die become deeper along its length until reaching the desired thread angle and depth. The thread forming dies include a stationary die and a moving die. The fastener blank is rolled therebetween causing the die faces to form the thread as the blank moves from the roll-up section, through the dwell section and out the roll-off section.

5 Claims, 4 Drawing Sheets

THREAD ROLLING DIES AND PROCESS FOR FORMING SAME

RELATED APPLICATIONS

This applications claims priority from U.S. Provisional Application No. 60/201,317 filed on May 2, 2000.

BACKGROUND OF THE INVENTION

I. Field of the Invention

This invention relates to dies for forming the helical threads on a metal fastener and, in particular, to thread rolling dies which prevent laps and discontinuities in the thread form during manufacture of the fastener.

II. Description of the Prior Art

Thread rolling dies have been used for many years to form the helical threads on a fastener which allows it to be threadably received within an aperture. In typical manufacturing, the fastener blank is formed to the desired length and diameter. The blank has a substantially smooth outer circumference. In order to form the threads in the blank, the blank is positioned between a pair of grooved dies. While one of the dies is kept stationary, the other die is moved longitudinally thereby rolling the blank along the dies. The grooves of the dies form the desired threads in the shank of the fastener as it moves across the dies. The grooves of the die are formed according to the desired depth and angle of the finished threads. In addition, the rolling dies must be configured to the diameter of the fastener blank.

While the use of standard thread rolling dies to form the threads works well for most fastener manufacturing, the use of such dies for fasteners causes laps in the thread form resulting in considerable scrap. The fastener blank can slip between the dies causing defective threads. The known thread rolling die geometry has been an obstacle to the mass production of lap free fasteners. Accordingly, a thread-rolling technique and a process of configuring thread dies which would produce defect-free threads while maintaining mass production rates is desired.

SUMMARY OF THE PRESENT INVENTION

The present invention overcomes the disadvantages of the prior known thread rolling dies by providing a method of designing and constructing thread rolling dies which produce lap-free threads in fastener blanks.

The thread rolling dies of the present invention generally include a pair of cooperating die members, one of which will be stationary as the other moves longitudinally relative thereto. As the die moves relative to the stationary die, the fastener blank will be rolled therebetween causing the metal to flow so as to form a thread having a shape determined by the profile of the lands and grooves machined in the opposing faces of the dies.

The geometry of the dies varies over the length of the die to gradually create the desired thread configuration. The starting end of the die has a roll-up ramp which includes shallower grooves to initially press the metal blank. The roll-up ramp gradually alters the groove angle from a relatively shallow angle up to the desired angle and depth thereby gradually forming the thread. A dwell section at the finish groove configuration follows the roll-up section such that a stable and well-defined thread form is created. The dwell section is followed by a rolloff section wherein the grooves ramp down to release the fastener.

The dies are designed to optimize lap-free production of the threaded fasteners. In contrast to prior known design methods for thread rolling dies, the sections of the die are calculated beginning at the back end of the die, in accordance with the diameter of the fastener blank. First, an appropriate roll-off section is calculated. Thereafter, the length of the dwell section with full depth grooves is calculated so that at least two complete rotations of the fastener occur across this section. This creates the stable and delved thread form. Finally, the roll-up ramp length is calculated providing the gradual formation of the thread. The constructed thread rolling dies eliminate laps and discontinuities in the thread form, particularly laps below the pitch line.

Other objects, features and advantages of the invention will be apparent from the following detailed description taken in connection with the accompanying drawing, in which like reference characters refer to like parts throughout the views and in which:

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
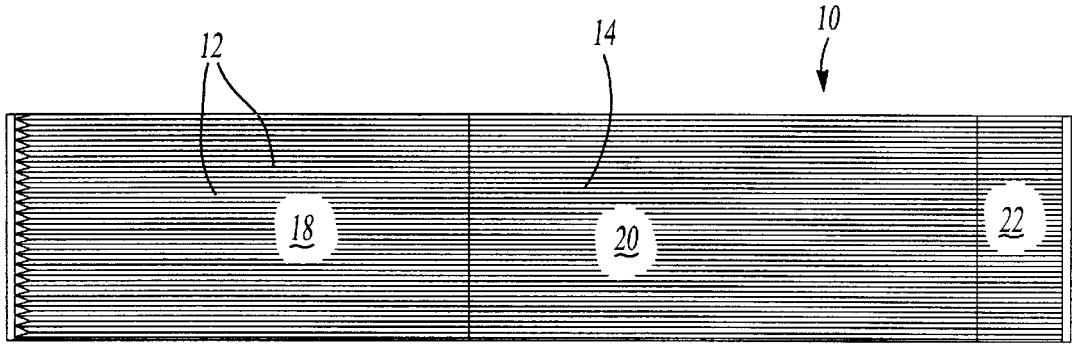
FIGS. 1–4 illustrates a first embodiment of the thread rolling dies of the present invention including side and top views and cross-sectional views of the thread forming grooves.
Figure 2:
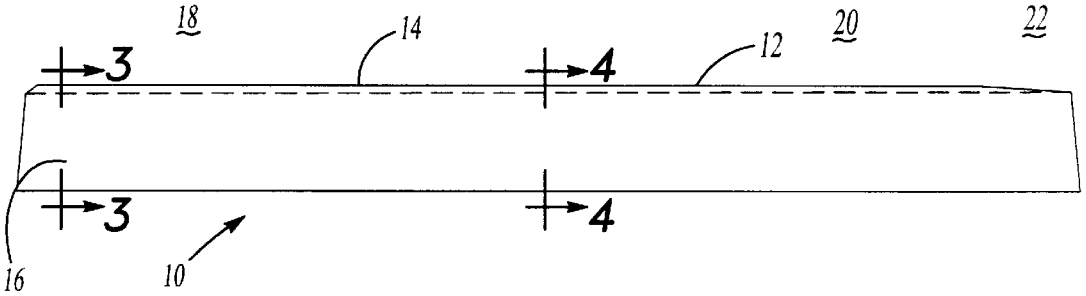
Figure 3:
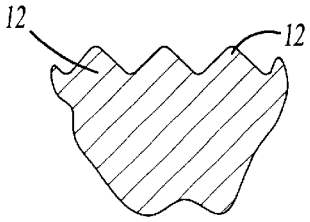
Figure 4:
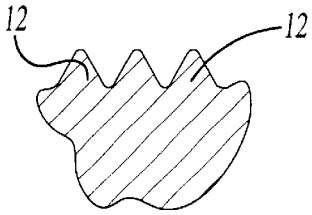
Figure 5:
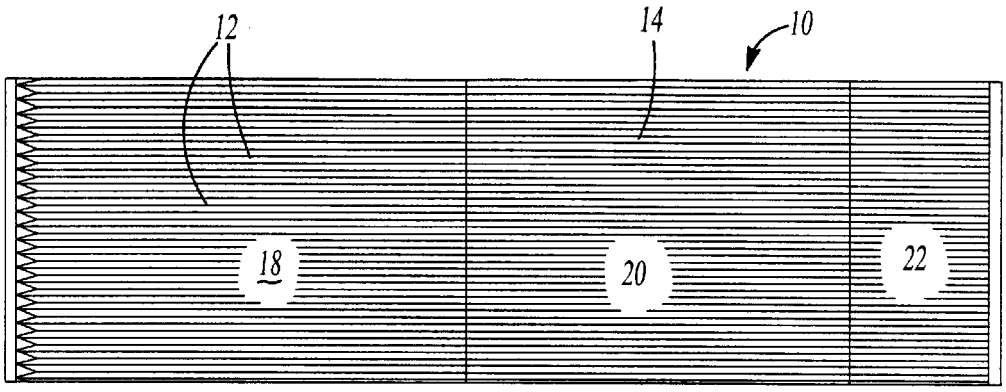
FIGS. 5–8 illustrates a second embodiment thereof.
Figure 6:
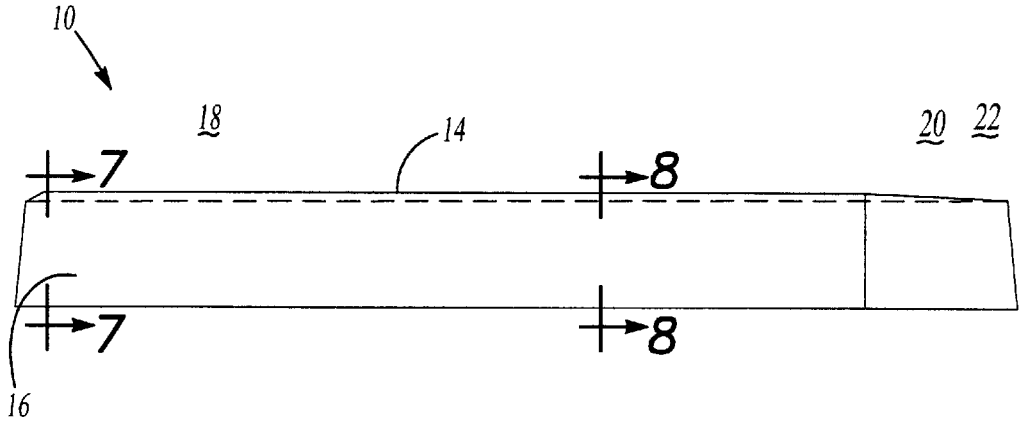
Figure 7:
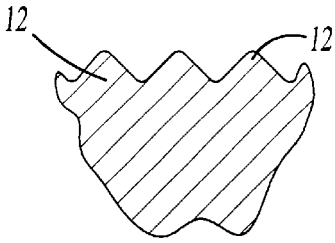
Figure 8:
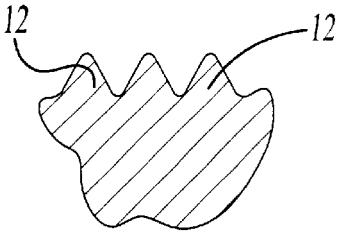
Figure 9:
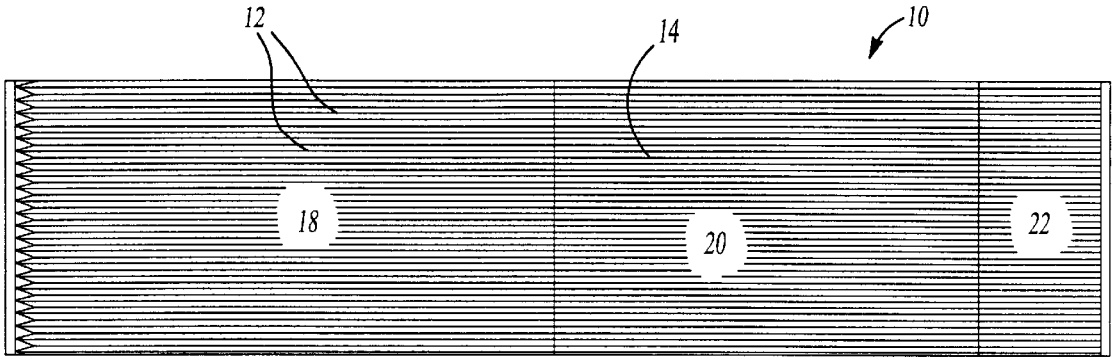
FIGS. 9–12 illustrates a third embodiment thereof.
Figure 10:
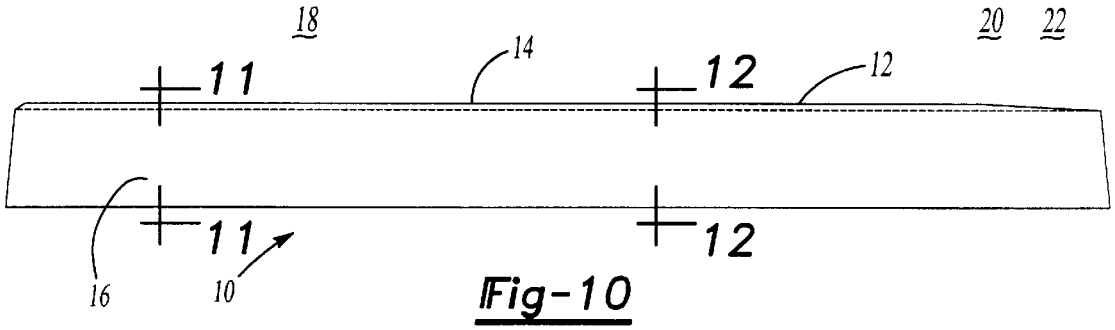
Figure 11:
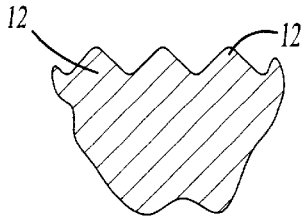
Figure 12:
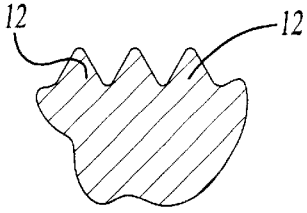
Figure 13:
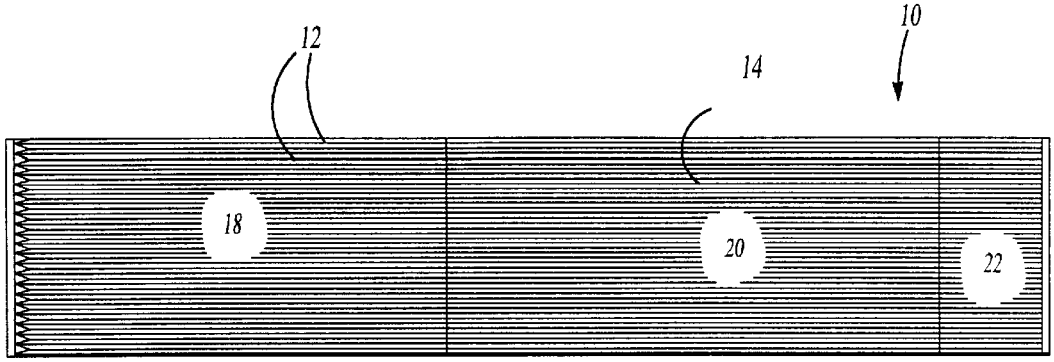
FIGS. 13–16 illustrates a fourth embodiment thereof.
Figure 14:
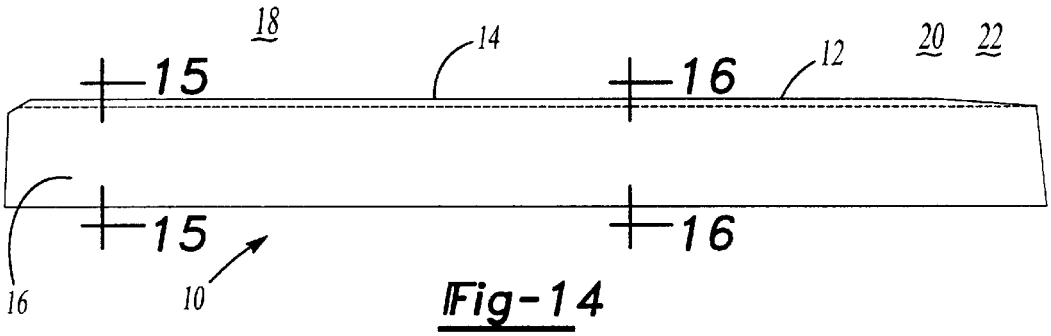
Figure 15:
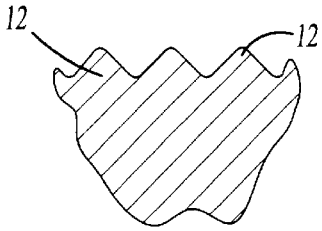
Figure 16:
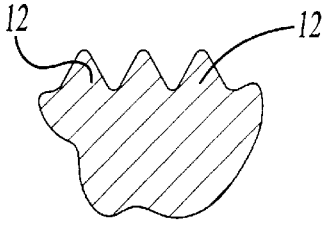

Referring to the drawing, there are shown several embodiments of a unique thread rolling die 10 for forming a thread in a metal fastener blank. Generally, the thread rolling dies 10 have a planar configuration with a plurality of grooves 12 formed in the face 14 of the die 10. The grooves 12 form the thread in the blank as the blank is rolled between a pair of the dies 10. The pressure applied by the two die plates causes the metal of the blank to flow into the grooves 12 to form the thread of the fastener. The various embodiments of the rolling dies 10 are designed to form different thread configurations on different blank diameters. The thread rolling dies 10 of the present invention create stable and well-defined thread forms that are lap free.

The thread rolling dies 10 of the present invention have substantially plate-like bodies 16 with the face 14 having a plurality of longitudinal grooves 12 formed in the face 14. The grooves 12 vary along the length of the die 10 so as to gradually form the thread as the blank moves along the length of the face 14. The face 14 can be substantially divided into three sections: a roll-up section 18, a dwell section 20 and a roll-off section 22. These sections of the die 10 are designed and constructed in accordance with the fastener size to prevent slippage which can cause laps to form in the threads.

The thread rolling die sets 10 include a stationary die and a moving die of similar configurations to form the thread. The roll-up section 18 of the die 10 gradually increases the groove depth from a start-up point to full thread depth. By way of example, the grooves 12 in the die face 14 have a depth of 0.06 inches and an included angle of 90° at the start end of the roll-up section 18 as shown at cross-section A—A. The grooves 12 of the roll-up section 18 gradually blend to full depth which in this example is approximately 0.08 inches with an included angle of 60°. At full depth begins the dwell section 20 which maintains the full depth of the grooves 12 over the length of the section 20. Optimally, the length of the dwell section 20 is designed such that at least two full rotations of the fastener blank occur during the thread forming process. The end of the thread rolling die 10 comprises the roll-off section 22 wherein the grooves 12 dwindle down to allow the threaded fastener to cleanly roll off of the die set 10.

The thread rolling dies 10 are operated in opposing pairs with one die 10 held stationary as the other die 10 is moved longitudinally thereby rolling the fastener blank between the dies to form the thread. The configuration of the dies 10 according to the present invention substantially reduces slippage of the fastener blank ensuring a continuous roll through the dies 10. The fastener blank is delivered to the die set 10 at the roll-up section 18. As the one die 10 is moved relative to the stationary die 10, the blank will roll along the die face 14. The blank moves along the roll-up section 18 causing the grooves 12 to form the metal gradually into the thread form. Once the threads are fully formed the blank will move through the dwell section 20 which ensures a well-defined thread before moving off the dies 10 through the roll-off section 22.

While thread rolling dies are well-known in the industry, the present invention defines a process for designing optimum thread rolling dies which minimize lapping and other defects in the thread form. Taking into account the diameter of the fastener blank and the desired thread configuration, each section of the dies 10 are independently designed and constructed. The roll-off section 22 is designed first to provide a gradual decrease in the grooves 12 to roll off the fastener blank. With the length and slope of the roll-off section 22 determined, the length of the dwell section 20 is calculated. The dwell section 20 with its full depth grooves 12 is designed such that the fastener blank completes at least two complete rotations in order to fully form the thread. The length of this section will be directly related to the diameter of the fastener blank. Finally, the length of the roll-up section 18 is calculated along with the depth and angle of the grooves 12 to form a stable and well-defined thread on the fastener.

The foregoing detailed description has been given for clearness of understanding only and no unnecessary limitations should be understood therefrom as some modifications will be obvious to those skilled in the art without departing from the scope and spirit of the appended claims:

What is claimed is:

1. A process of forming a thread rolling die adapted to form a thread on a fastener blank having a predetermined diameter comprising the steps of:

calculating a roll-off section of said die and forming said roll-off section in a face of said die wherein thread forming grooves in said die face taper downwardly from a full depth;

calculating a dwell section of said die and forming said dwell section in said die face proximate said roll-off section wherein said thread forming grooves are maintained at said full depth along the length of said dwell section, said dwell section having a length proportional to the diameter of the fastener blank; and calculating a roll-up section of said die and forming said roll-up section in said die face proximate said dwell section wherein said grooves at a start end of said roll-up section are formed at a shallower depth and a shallower angle than said full depth grooves at an exit end of said roll-up section, said thread forming grooves increasing to said full depth along a length of said roll-up section.

2. The process as defined in claim 1 wherein said length of said dwell section is calculated such that the fastener blank completes at least two rotations over the length of said dwell section.

3. The process as defined in claim 2 wherein said grooves at a start end of said roll-off section are formed at said full depth and taper downwardly toward an exit end of said roll-off section.

4. The process as defined in claim 3 wherein a length of said roll-off section is calculated proportional to at least two times the rolling blank circumference to insure that minimum rolling requirements are met.

5. A thread rolling die for formation of a helical thread in a fastener blank, said die having a die face with a plurality of thread forming grooves equally spaced along a width of said die face, said thread rolling die comprising:

a roll-up section extending from a start end of said die, said grooves of said roll-up section progressively increasing in depth from said start end to a full depth of an exit end of said roll-up section;

a dwell section extending from said exit end of said roll-up section, said dwell section grooves being maintained at said full depth along the full length of said dwell section, said length of said dwell section being proportional to a diameter of the fastener blank such that the fastener blank completes at least two rotations through said dwell section; and a roll-off section proximate said dwell section, said grooves of said roll-off section progressively decreasing in depth from said full depth at a start end of said rolloff section.

* * * * *